US008484912B2

(12) United States Patent
Engelmeyer

(10) Patent No.: US 8,484,912 B2
(45) Date of Patent: Jul. 16, 2013

(54) SPACER TUBE

(75) Inventor: Joerg Engelmeyer, Wuppertal (DE)

(73) Assignee: Helmut Lingemann GmbH & Co. KG, Wuppertal (DE)

( * ) Notice: Subject to any disclaimer, the term of this patent is extended or adjusted under 35 U.S.C. 154(b) by 166 days.

(21) Appl. No.: 12/589,166

(22) Filed: Oct. 19, 2009

(65) Prior Publication Data

US 2010/0107529 A1 May 6, 2010

(30) Foreign Application Priority Data

Oct. 20, 2008 (DE) ..... 10 2008 052 318

(51) Int. Cl.
*E06B 3/54* (2006.01)

(52) U.S. Cl.
CPC ..... *E06B 3/5409* (2013.01)
USPC ..... 52/204.593; 52/204.591; 52/786.13

(58) Field of Classification Search
USPC ..... 52/204.591, 204.593, 843, 847, 786.13
See application file for complete search history.

(56) References Cited

U.S. PATENT DOCUMENTS 4,120,999 A * 10/1978 Chenel et al. ..... 52/786.13
4,402,170 A * 9/1983 Seidner ..... 52/843
5,466,534 A 11/1995 Newby
5,512,341 A * 4/1996 Newby et al. ..... 52/786.13
6,061,994 A * 5/2000 Goer et al. ..... 52/843
6,339,909 B1 1/2002 Brunnhofer et al.
6,370,838 B1 * 4/2002 Evason et al. ..... 52/204.593
7,700,172 B2 * 4/2010 Renn ..... 428/36.5

FOREIGN PATENT DOCUMENTS

DE 196 02 455 7/1997
DE 298 14 768 2/1999
EP 1 394 456 3/2004
WO WO 03/074831 9/2003

OTHER PUBLICATIONS

European Search Report dated Jan. 20, 2010 in European Patent Application No. 09 17 0826 with an English translation of the relevant parts.
DIN EN ISO 527-1, Apr. 1996, total of twelve pages. (Spec, p. 11).
DIN EN ISO 179-1, Nov. 2010, total of twenty-nine pages. (Spec, p. 11).
DIN EN ISO 1133, Sep. 2005, total of twenty-one pages. (Spec, p. 11).
Rolltech Brochure "Data sheet Psi values for windows", Oct. 2008, Hjørring, Denmark, No. 14, No. 10, No. 9.

* cited by examiner

*Primary Examiner* — Mark Wendell
*Assistant Examiner* — Matthew J Smith
(74) *Attorney, Agent, or Firm* — Collard & Roe, P.C.

(57) ABSTRACT

A tubular hollow profile, particularly a spacer tube for the production of spacer frames for insulated glazing, has a profile wall. The profile wall is configured to be double-walled and has an outer wall made of metal, particularly stainless steel or aluminum, and an inner wall made of plastic, which are connected with one another, preferably in firm, i.e. non-displaceable manner. A device and a method for production of the hollow profile are also provided.

9 Claims, 6 Drawing Sheets

SPACER TUBE

CROSS REFERENCE TO RELATED APPLICATIONS

Applicant claims priority under 35 U.S.C. §119 of German Application No. 10 2008 052 318.6 filed on Oct. 20, 2008.

BACKGROUND OF THE INVENTION

1. Field of the Invention

The present invention relates to a thin-walled, tubular hollow profile, particularly a spacer tube for the production of spacer frames of insulated glazing, as well as to a method and a device for its production.

2. The Prior Art

Conventional insulated glazing has at least two panes of glass disposed parallel to and spaced apart from one another, between which a pane interstice having a defined width is provided. In order to permanently guarantee this predefined pane interstice, a circumferential space holder frame is provided between the two glass panes, which frame connects the two glass panes with one another in the region of their outer pane edges. In this connection, the spacer frame consists of a thin-walled spacer tube having an essentially flat rectangular cross-section, which was bent accordingly to form the spacer frame. Alternatively, the spacer frame consists of multiple individual spacer tubes, which are set onto one another via corner connectors.

Such spacer tubes are hollow profiles made of aluminum, for example, which are produced for example, by means of bending by rollers and subsequent welding of the abutting longitudinal edges of the aluminum strip. These spacer tubes have a wall thickness of 0.3 mm to 0.6 mm. Because of the good heat conductivity of aluminum, however, these spacer tubes made of aluminum have the disadvantage that the region of the outer pane edges, i.e. the pane border region, cools greatly at low outside temperatures. As a result, valuable heat energy is lost. If the temperature furthermore drops to below the dew point in this region, condensate forms, and this condensate can damage the frame construction, particularly in the case of wooden windows.

In order to reduce these effects, more and more spacer tubes made of materials that have clearly lesser heat conductivity have been in use since approximately the mid-1990s, and particularly within the course of the energy savings regulations (EnEV) that went into effect in 2002. In this connection, the term "warm edge" was coined. This term is used for the region of an insulated glazing in which the outer pane edges are connected with one another by means of the spacer tubes, whereby the spacer tubes consist of a material having low heat conductivity.

For example, such spacer tubes consist of stainless steel and have a wall thickness of 0.15 mm to 0.2 mm. These stainless steel spacer tubes are also produced from a stainless steel strip, by means of bending by rollers and subsequent welding of the abutting longitudinal edges of the strip. The spacer tubes made of stainless steel are characterized in that they can be easily processed further, particularly by machine. The spacer tubes can be cut to the correct length and bent to form the spacer frames, in simple manner. The material costs of stainless steel in particular, however, have increased tremendously in recent years.

Furthermore, spacer tubes made of plastic exist, which are produced by means of extrusion. Spacer tubes made of polymer materials having low heat conductivity values have a lower heat passage coefficient in comparison with spacer tubes made of stainless steel. Although such spacer tubes can be produced more cost-advantageously, further processing, particularly bending to form the spacer frames, is difficult. Furthermore, plastic is not ultra-violet (UV) ray resistant, tends to age, and is not completely diffusion-tight. For this reason, it is known to cover the backs of the spacer tubes with a metallic foil. The foil acts as a diffusion barrier. The other stated disadvantages of the spacer tubes made of plastic, however, are not eliminated with this cover.

SUMMARY OF THE INVENTION

It is therefore an object of the present invention to provide a tubular, thin-walled hollow profile, particularly a spacer tube for the production of spacer frames of insulated glazing, having a low heat passage value, which can be produced in simple and cost-advantageous manner, and can easily be processed further.

Another object of the invention is to provide a device and a production method for simple and cost-advantageous production of such a hollow profile.

In one aspect, these and other objects are achieved by a tubular hollow profile, particularly a spacer tube for the production of spacer frames for insulated glazing having a profile wall configured to be double-walled and having an outer wall made of metal, particularly stainless steel or aluminum, and an inner wall made of plastic, which are connected with one another, preferably in firm, i.e. non-displaceable manner.

In another aspect, a device is provided according to the invention for production, particularly continuous production, of a tubular hollow profile, particularly of a hollow profile according to the first aspect of the invention above.

The device has, expediently, a metal strip cutting device for cutting a metal band, particularly a stainless steel band or an aluminum band, into multiple longitudinal metal strips that are parallel to one another, particularly stainless steel strips or aluminum strips.

The device further includes, expediently, a plastic strip cutting device for cutting a plastic band into multiple longitudinal plastic strips that are parallel to one another.

The device also includes a gluing device for gluing the metal strip to the plastic strip to form a profile wall strip having two lateral longitudinal edges, and, expediently, a notching or stamping device for introducing longitudinal grooves into a plastic strip top side of the plastic strip that faces away from the metal strip.

The device also includes a device for bending by rollers for deforming the profile wall strip to form a longitudinally slit endless hollow profile whose regions that have the longitudinal edges abut one another, and a welding device for producing a longitudinal weld seam by means of welding the two regions that have the longitudinal edges to one another.

The device also includes, expediently, a calibration device for calibrating the cross-sectional shape of the endless hollow profile, and a cutting device for cutting the endless hollow profile into hollow profiles having a predetermined length.

In a third aspect, a method is provided according to the invention for production, particularly continuous production, of a hollow profile according to the first aspect of the invention above, preferably using a device according to the second aspect of the invention above.

In accordance with the method, expediently, a metal band, particularly a stainless steel band or an aluminum band, is cut into multiple longitudinal metal strips that are parallel to one another, particularly longitudinal stainless steel strips or longitudinal aluminum strips.

Also, in accordance with the method, expediently, a plastic band is cut into the multiple longitudinal plastic strips that are parallel to one another, and the metal strip is glued to the plastic strip to form a profile wall strip having two lateral longitudinal edges.

Expediently, longitudinal grooves are introduced into a plastic strip top side of the plastic strip that faces away from the metal strip, and the profile wall strip is subjected to rolling deformation to form a longitudinally slit endless hollow profile whose two regions that have the longitudinal edges abut one another, whereby the profile wall strip is bent in such a way that the metal strip forms an outer wall and the plastic strip forms an inner wall of the endless hollow profile.

A longitudinal weld seam is produced by means of welding the two regions that have the longitudinal edges to one another. Expediently, the endless hollow profile is calibrated to its final cross-sectional shape, and cut into hollow profiles having a predetermined length.

Advantageous further aspects of the invention are discussed below.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
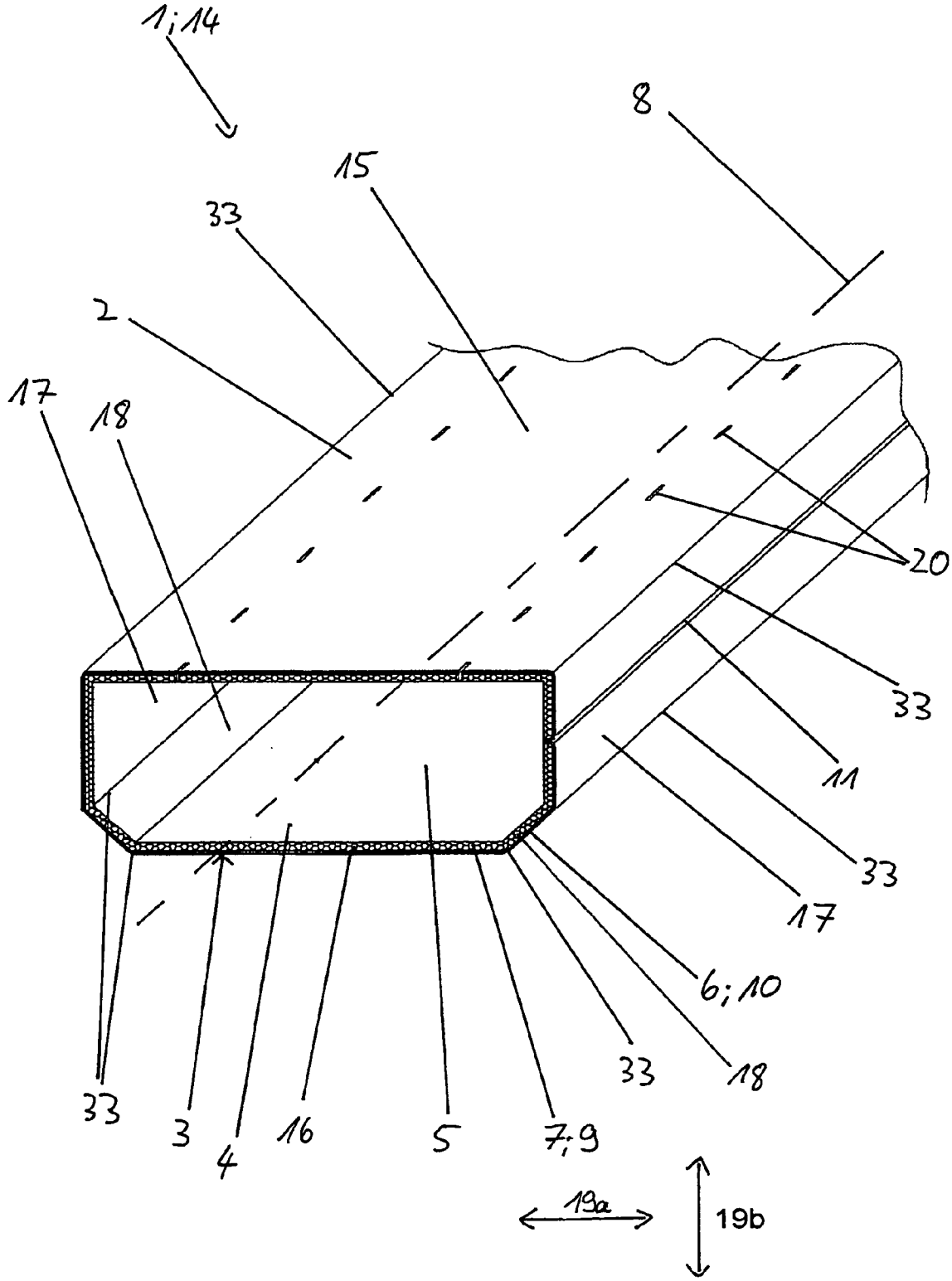
FIG. 1 is a perspective cross-sectional view of the hollow profile according to the invention in the form of a spacer tube.
Figure 2:
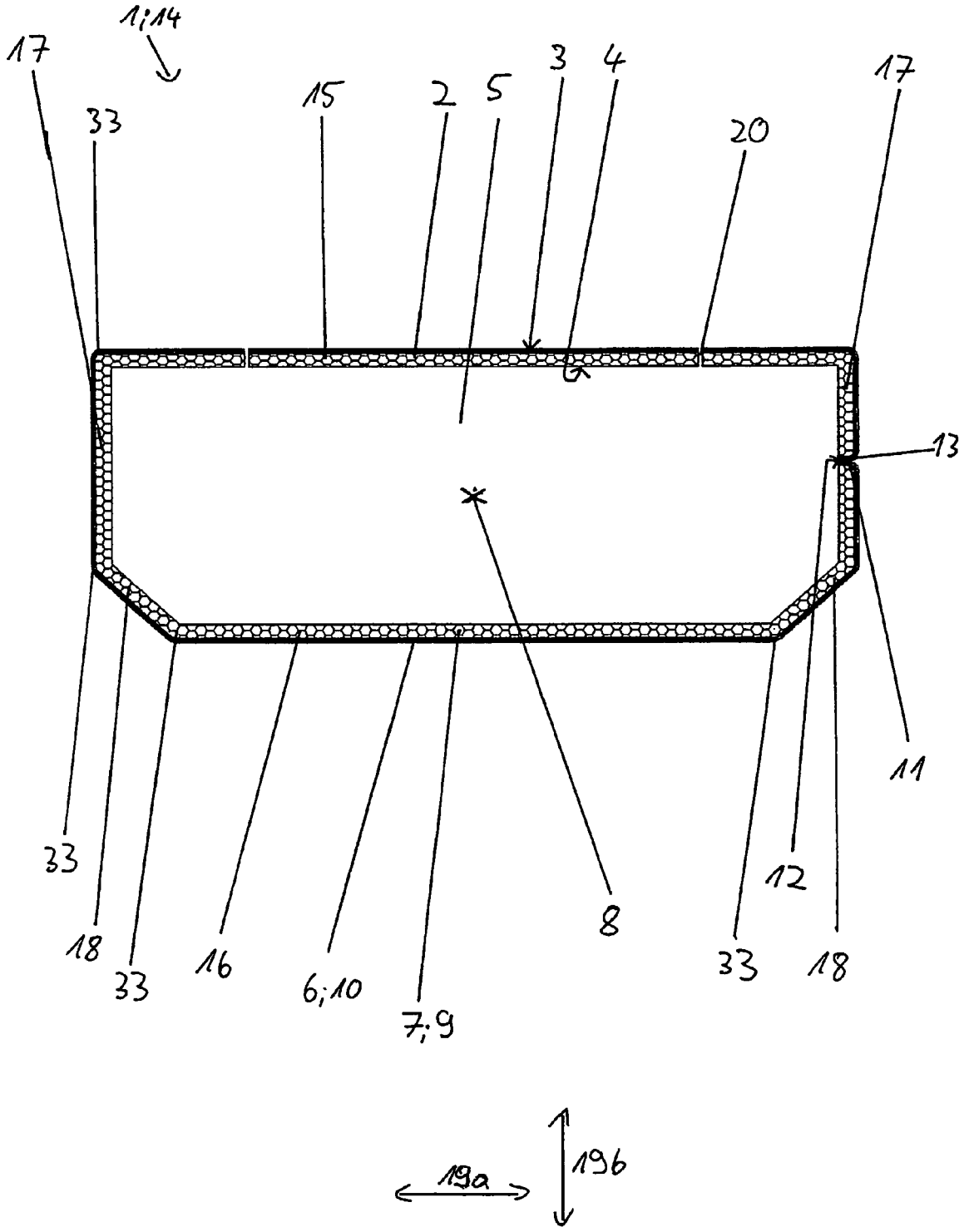
FIG. 2 shows a cross-section of the hollow profile of FIG. 1.

Turning now in detail to the drawings and in particular FIGS. 1 and 2, the thin-walled hollow profile 1 according to the invention is shown. Hollow profile 1 has a profile wall 2 having an outer profile surface 3 and an inner profile surface 4, whereby inner profile surface 4 encloses, i.e. establishes a profile interior 5. According to the invention, hollow profile 1 is furthermore configured to be double-walled, in other words profile wall 2 has an outer wall 6 and an inner wall 7, which are connected with one another, preferably in firm, i.e. non-displaceable manner. In this connection, outer wall 6 consists of metal, particularly stainless steel or aluminum, and inner wall 7 consists of plastic. Furthermore, outer wall 6 has a wall thickness of preferably 0.04 mm to 0.1 mm, preferably 0.05 mm to 0.08 mm. Inner wall 7 has a wall thickness of preferably 0.15 mm to 0.5 mm, preferably 0.3 mm. Furthermore, hollow profile 1 has a longitudinal expanse in the direction of a longitudinal profile axis 8.

In this connection, the material of inner wall 7 is preferably a degradable, i.e. compostable plastic, which expediently consists of a renewable resource. Furthermore, it is practical if the plastic is suitable for being treated with ultrasound, particularly being stamped, i.e. notched by means of ultrasound, and if the plastic is suitable for being injection-molded and extruded. In particular, the plastic has biopolymers, preferably polyhydroxyalkanoates and/or polycaprolactone and/or polyester and/or lignin, and/or lignocellulose and/or natural resins and/or natural fatty acids and/or natural waxes, i.e. consists of these substances. It is practical if the melting point of the plastic lies at 100-170° C., preferably 120-150° C. Furthermore, the plastic preferably has the following material properties (alternatively or cumulatively).

| | Standard | | preferably |
|---|---|---|---|
| Tensile strength $\sigma_M$ [MPa] | DIN EN ISO 527 | 40 to 60 | 45 to 55 |
| Elongation $\epsilon_M$ [%] | DIN EN ISO 527 | 2 to 2.8 | 2.3 to 2.5 |
| Breaking strength $\sigma_B$ [MPa] | DIN EN ISO 527 | 20 to 30 | 23 to 27 |
| Elongation to break $\epsilon_M$ [%] | DIN EN ISO 527 | 7 to 10 | 9 to 9.8 |
| Tensile E-modulus E [MPa] | DIN EN ISO 527 | 2600 to 2800 | 2720 to 2780 |
| Impact resistance (23° C.) $a_{eU}$ [kJm$_2$] | EN ISO 179/1 | 50 to 65 | 55 to 60 |
| Melt index (190° C./2.16 kg) [g/1 min] | DIN ISO 1133 | 3 to 5 | 4 to 4.5 |
| Density [g/cm$^3$] | | 1 to 1.3 | 1.2 to 1.25 |

Hollow profile 1 according to the invention is produced from a double-layer profile wall strip 29 (FIG. 3) by means of rolling deformation; this strip has a metal strip 10, particularly a stainless steel strip or aluminum strip, coated with a plastic strip 9, all of which will be discussed in greater detail below. As a result, hollow profile 1 has a longitudinal weld seam 11 that extends parallel to the longitudinal profile axis 8. The regions of two longitudinal edges 12 of metal strip 10 that are adjacent to one another after bending by rollers are welded to one another by means of longitudinal weld seam 11. In particular, outer wall 6 is bent around into the profile interior 5 in the region of the two longitudinal edges 12, so that two flange cheeks 13 are formed, whereby the two flange cheeks 13 lie against one another and are connected with one another by means of longitudinal weld seam 11. Longitudinal weld seam 11 is therefore preferably a beaded seam, and the weld connection is configured as a flange weld connection. Alternatively, longitudinal weld seam 11 can also be configured as an overlapping weld or as a butt weld.

Furthermore, hollow profile 1 is preferably a spacer tube 14 from which spacer frames for insulated glazing can be produced. For this purpose, spacer tube 14 has an essentially rectangular cross-section, whereby profile wall 2 has a ceiling wall 15 that is preferably planar, a floor wall 16 that expediently lies parallel to the former and is preferably planar, and two side walls 17 that are preferably planar. Side walls 17 are preferably disposed perpendicular to ceiling wall 15 and to floor wall 16. Furthermore, it is practical if a transition wall 18 is provided between a side wall 17 and the floor wall 16, in each instance. Side walls 17 and ceiling wall 15 preferably make a direct transition into one another. Furthermore, the walls 15; 16; 17; 18 that lie adjacent to one another are disposed angled relative to one another, in each instance, and make a transition into one another by way of a bent edge, i.e. corner edge 33, in each instance. In this connection, the two transition walls 18 are preferably configured as a type of bevel, in other words the corner region between a side wall 17 and the floor wall 16, in each instance, is flattened by means of transition walls 18.

Furthermore, it is practical if the expanse of the spacer tube 14 is greater in a width direction 19*a* that lies perpendicular to longitudinal axis 8 than in a height direction 19*b* that is perpendicular to the former and to the longitudinal axis 8. In this connection, ceiling wall 15 and floor wall 16 extend parallel to longitudinal axis 8 and to width direction 19*a*, and side walls 17 extend parallel to longitudinal axis 8 and to height direction 19*b*.

In the installed state of spacer tube 14 in the insulated glazing, ceiling wall 15 is disposed facing a pane interstice formed between two panes, and the two side walls 17 lie against the glass panes and are connected with them in known manner, to be moisture-tight and air-tight, by means of a suitable adhesive. Floor wall 16 consequently faces away from the pane interstice. As a consequence, longitudinal weld seam 11, in order not to be visible in the installed state of spacer tube 14, is preferably not disposed in the region of ceiling wall 15. Preferably, longitudinal weld seam 11 is disposed in the region of one of the side walls 17.

Furthermore, preferably multiple known passage recesses, i.e. perforation openings 20, preferably in the form of slits that pass through ceiling wall 15, are made, particularly punched, into ceiling wall 15, whereby perforation openings 20 create a connection, in terms of flow technology, between the profile interior 5 and the pane interstice. Perforation openings 20 can also be configured, at least in part, as oblong holes that extend parallel to width direction 19*a* (not shown).

Figure 6:
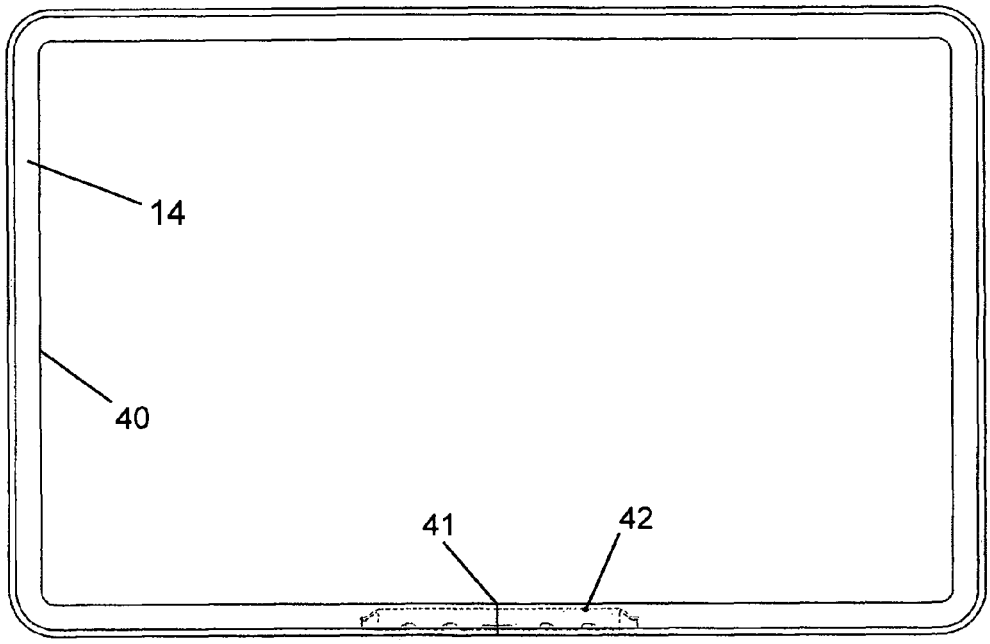
FIG. 6 is a perspective view of a spacer tube according to the invention, the spacer tube having been bent to form a spacer frame.

FIG. 6 shows a spacer frame 40 for insulated glazing which is formed by bending the spacer tube 14 that is described herein. The spacer frame 40 includes a separating cut 41 and a connector 42.

In the following, the production of hollow profile 1 according to the invention will now be explained in greater detail, particularly using the production of spacer tube 14, by means of the device according to the invention.

As already explained above, production of hollow profile 1 takes place by means of bending by rollers and longitudinal welding. For this purpose, first a relatively broad metal band, particularly a stainless steel band or an aluminum band, is cut into multiple longitudinal metal strips 10 that lie parallel to one another, particularly longitudinal stainless steel strips or longitudinal aluminum strips, and these are preferably wound up onto a reel. Alternatively, metal strips 10 are already present wound up onto a reel.

It is practical if, at the same time with the production of metal strips 10, a relatively broad plastic band is cut into multiple plastic strips 9 that lie parallel to one another, in a plastic strip cutting device, and these are preferably wound up onto a reel. Alternatively, plastic strips 9 are also already present wound up onto a reel. In particular, the plastic band or the plastic strips 9 are produced by means of extrusion.

Figure 4:
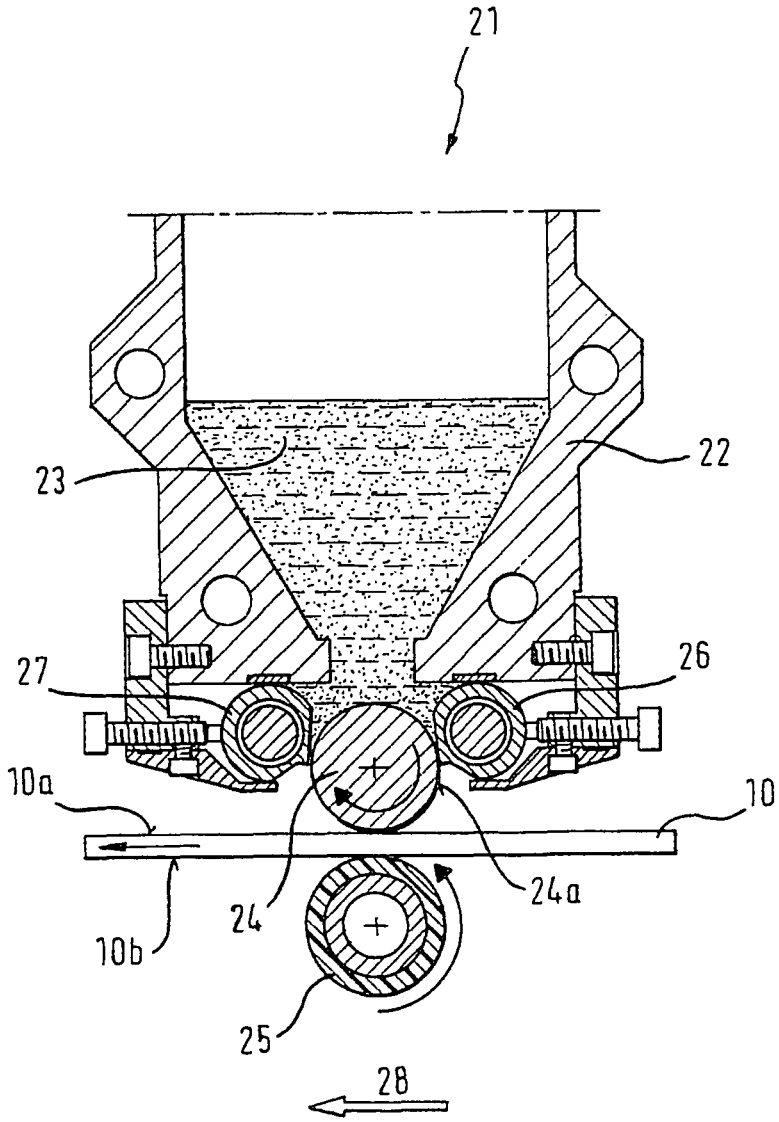
FIG. 4 is a cut side view of an adhesive application device of a gluing device of the device according to the invention.

Subsequently, the two strips 9; 10 are glued to one another in a gluing device, expediently using a melt adhesive 23. For this purpose, the gluing device has an adhesive application device 21 (FIG. 4) that has a heated melting tank 22 for accommodating liquid melt adhesive 23, an application roller 24 that can be driven about a horizontal axis of rotation, a counter-pressure roller 25 that can also be driven about a horizontal axis of rotation, but in the opposite direction of rotation, and, expediently, two strippers 26, 27, namely a metering stripper 26 and a closing stripper 27. In this connection, application roller 24 is disposed below melting tank 22, so that it closes melting tank 22 off toward the bottom and melt adhesive 23 is distributed on the region of a mantle surface 24*a* of application roller 24 that faces melting tank 22.

The two strippers 26; 27 are disposed adjacent to application roller 24, spaced apart from application roller 24 by a ring-shaped gap. In this connection, the distance of metering stripper 26 from application roller 24 determines the thickness of the adhesive layer that application roller 24 has on its mantle surface 24*a* after it passes metering stripper 26, and thus the thickness of the adhesive layer to be applied. Closing stripper 27 prevents adhesive from exiting when roller 24 is at rest.

Figure 3:
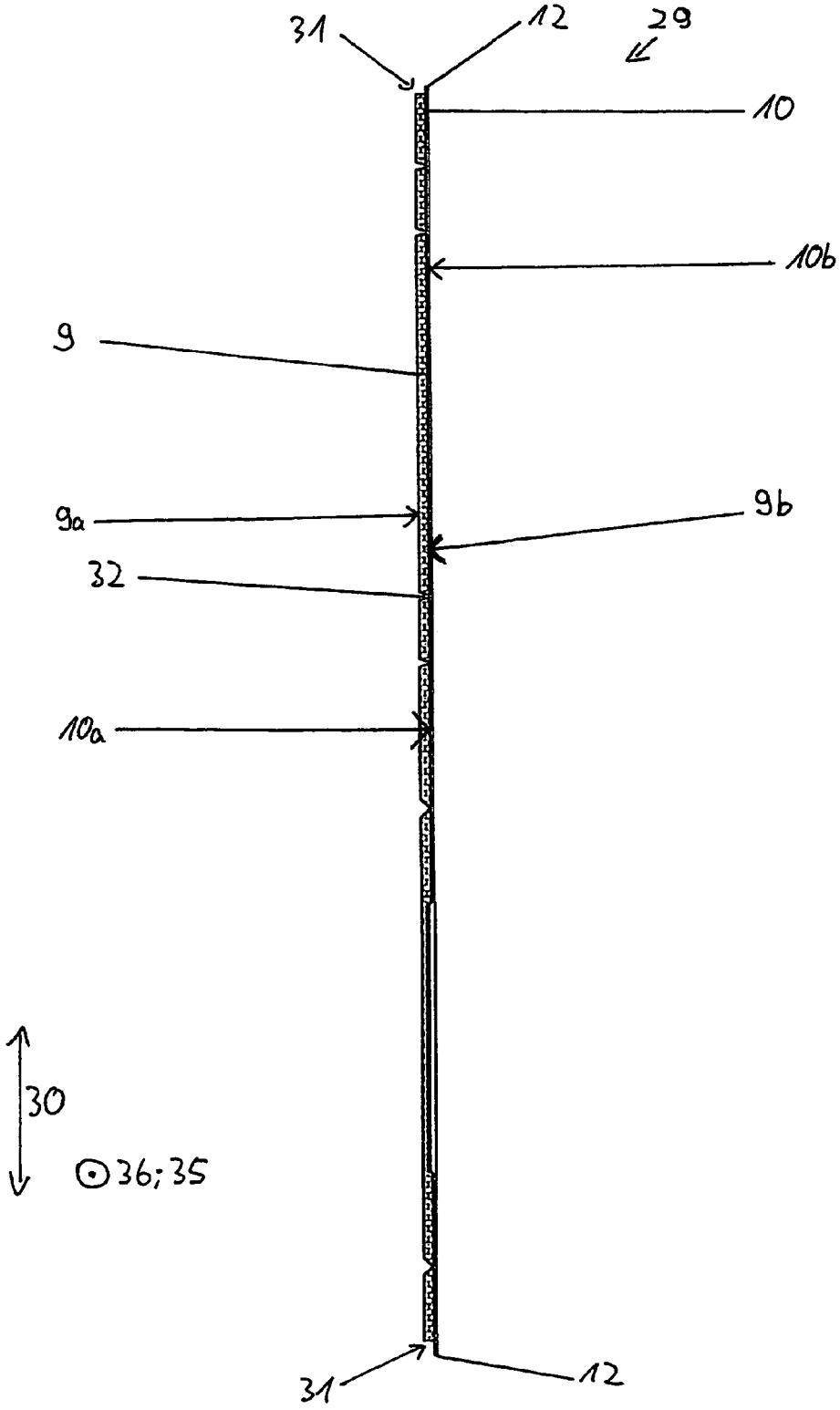
FIG. 3 shows a cross-section of a profile wall strip made from a metal strip coated with a plastic strip, having longitudinal beads made in the plastic strip, before rolling deformation to form the hollow profile according to the invention.

To apply melt adhesive 23 to a metal strip 10, metal strip 10 is guided through between the two rollers 24; 25 in a transport direction 28. In this connection, melt adhesive 23 picked up by application roller 24 from melting tank 22 is applied to a metal strip top side 10*a* of metal strip 10. After adhesive 23 has been applied, plastic strip 9 is laid onto metal strip top side 10*a* with a plastic strip underside 9*b* and pressed onto it, so that the two strips 9; 10 are glued to one another over their full area and form profile wall strip 29. In particular, in this connection, plastic strip 9 is laid onto metal strip 10 centered with reference to the expanse of profile wall strip 29 in a strip width direction 30. Furthermore, the expanse of plastic strip 9 in the strip width direction 30 is less than the expanse of metal strip 10 in the strip width direction 30, so that an edge region 31 of the metal strip is uncoated on both sides, in each instance (FIG. 3). In this connection, joining of plastic strip 9 and metal strip 10 preferably takes place continuously, by means of transporting the metal strip 10 in its longitudinal direction, particularly horizontally, drawing plastic strip 9 from the reel, laying plastic strip 9 onto metal strip 10, and pressing the two strips 9; 10 against one another by means of rollers.

In this connection, the melt adhesive 23 used is preferably a hot-melt adhesive, particularly a single-component polyurethane adhesive, whose basic substances are, in particular, polyurethane prepolymers having isocyanate groups. It is practical if the melt adhesive 23 used has a density of 1.15 to 1.25 g/cm$^3$. Furthermore, the melt adhesive 23 preferably has a (dynamic) viscosity of 18,000 to 34,000 MPas. The melt adhesive 23 is furthermore preferably insoluble in water.

It is practical if the profile wall strip 29 produced by means of gluing is passed to a drying device, particularly a drying segment, in which the melt adhesive 23 can dry and harden.

Subsequently, profile wall strip 29 is passed to a notching or stamping device of the device according to the invention, by means of which longitudinal grooves or longitudinal beads or notches 32 that extend longitudinally are made, particularly stamped, in a plastic strip top side 9*a* that faces away from metal strip 10. Longitudinal grooves 32 extend parallel to a longitudinal strip direction 36 and expediently have a V-shaped cross-section. Longitudinal grooves 32 are made where the bent edges 33 of the subsequent hollow profile 1 lie. In this connection, it is practical if introduction of longitudinal grooves 32 takes place by heating the plastic material by means of ultrasound, and stamping the preferably wedge-shaped longitudinal grooves 32 into the heated material. For this purpose, the notching device has an ultrasound generation device, a sonotrode for passing the vibrations that are generated to the plastic strip 9 to be stamped, and an anvil roller that can be driven about a horizontal axis of rotation. The anvil roller is disposed below the sonotrode, and disposed spaced apart from the latter by a defined gap. The sonotrode has a horizontal stamping surface that faces the anvil roller, which has multiple bulges that are disposed adjacent to one another and stand away from the stamping surface, for making longitudinal grooves 32. The bulges extend parallel to a transport direction, expediently a horizontal direction, and are disposed adjacent to one another perpendicular to the transport direction. In this connection, the placement and the number of bulges depends on the placement and the number of bent edges 33. For stamping, profile wall strip 29 is guided through between the stamping surface and the anvil roller, with the plastic top side 9*a* facing the sonotrode, in the transport direction, which is parallel to the longitudinal strip direction 36. In this connection, the plastic material is heated by means of the sonotrode, and longitudinal grooves 32 are stamped into plastic strip top side 9*a* by means of the bulges, with the application of pressure.

According to another embodiment of the invention, a rotating sonotrode that can be driven about a horizontal axis of rotation, in the direction of rotation opposite to the anvil roller, is used in place of the fixed sonotrode, whereby the speeds of rotation are synchronized. In this case, the sonotrode has ring-shaped bulges on its sonotrode mantle surface that project from that surface, which serve to introduce longitudinal grooves 32. For this purpose, the bulges extend circumferentially in the circumference direction of the sonotrode roller.

After introduction of longitudinal grooves 32, it is practical if the passage holes 20 are introduced into profile wall strip 29, in known manner, in a punching device. For this purpose, profile wall strip 29 is guided between two punching rollers that are driven about a horizontal axis, in each instance, and spaced vertically apart from one another, in a transport direction that is preferably horizontal, parallel to the longitudinal strip direction 36. The punching rollers have appropriate punching means. In particular, the one punching roller has teeth that project from its mantle surface, and the other punching roller has recesses that correspond to them.

After passage holes 20 have been made, profile wall strip 29 is continuously deformed in a device for bending by rollers, i.e. rolling deformation device of the device according to the invention, by means of rolling deformation, to form a longitudinally slit endless hollow profile 38, in such a manner that its cross-sectional shape preferably already corresponds to the cross-sectional shape desired later. In particular, first the two free edge regions 31 are bent around to form the flange cheeks 13, and subsequently, profile wall strip 29 is bent to form the longitudinally slit endless hollow profile 38, in such a manner that the two flange cheeks 13 abut one another. In particular, profile wall strip 29 is bent, i.e. bent around at longitudinal grooves 32. Profile wall strip 29 is therefore bent about axes that lie parallel to the longitudinal strip direction 36, i.e. the subsequent longitudinal axis 8.

Furthermore, profile wall strip 29 is deformed in such a manner that metal strip 10 lies on the outside, in particular, metal strip underside 10*b* forms the outer profile surface 3 and it is practical if the two flange cheeks 13 are disposed at the top. To implement an overlapping weld seam or a butt weld, appropriate preparation takes place as required.

Rolling deformation takes place in known manner, using corresponding rolling deformation tools, particularly using multiple pairs of deformation rollers (not shown) that are disposed one behind the other in a transport direction that lies parallel to the longitudinal strip direction 36, preferably a horizontal direction, in which the profile wall strips 29 are transported.

In this connection, profile wall strip 29 is guided between the two deformation rollers of a pair of deformation rollers, in each instance. In this connection, the one deformation roller has a circumference surface curved to be concave, and the other deformation roller has a circumference surface curved to be convex, whereby the circumference surfaces are coordinated with one another, and the curvature increases from one pair of deformation rollers to another, in such a way that the profile wall strip 29 is gradually bent into the longitudinally slit endless hollow profile 38.

Figure 5:
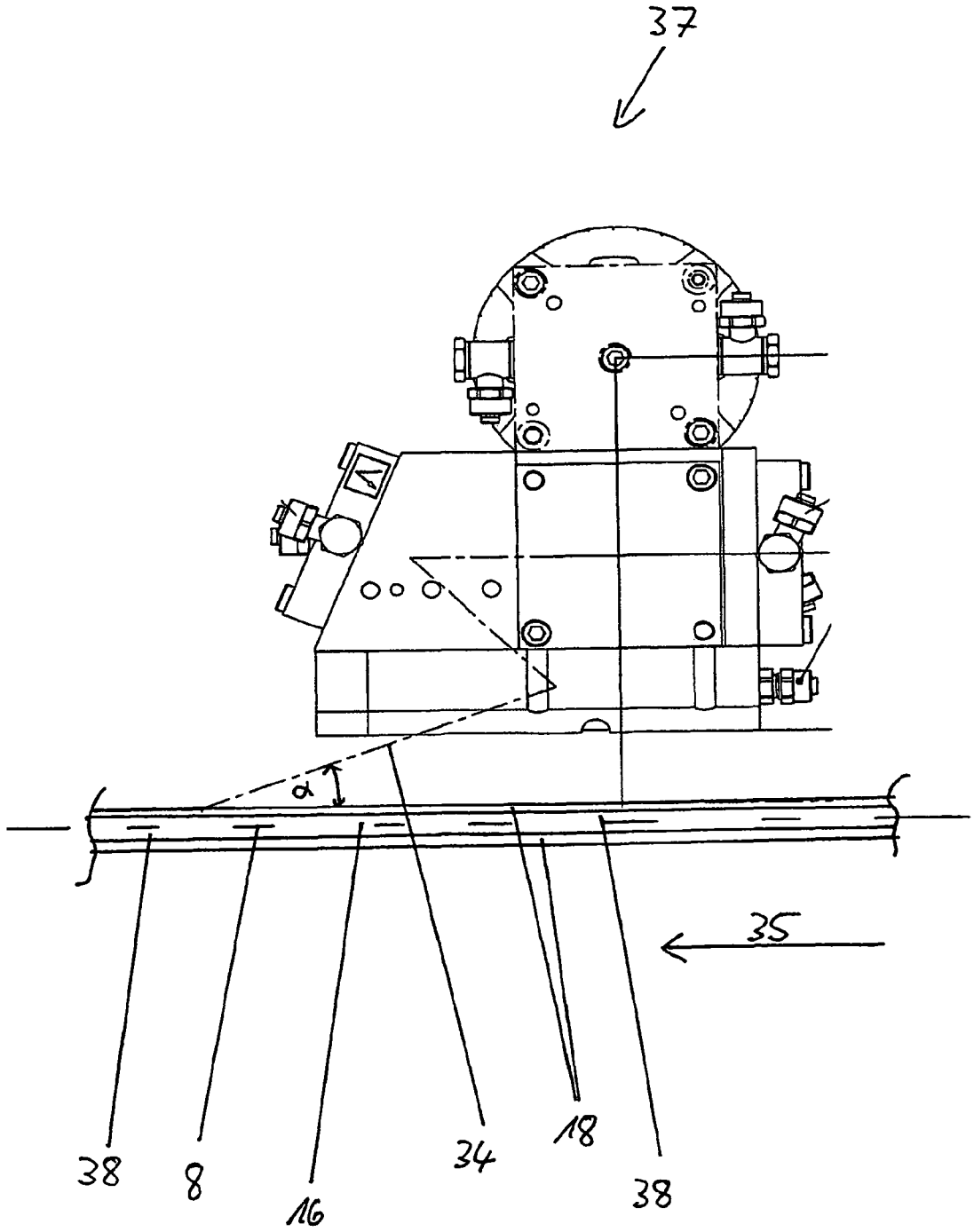
FIG. 5 is a side view of a welding device of the device according to the invention.

In a welding device 37 of the device according to the invention, which follows the rolling deformation device, the two flange cheeks 13 that abut one another are welded to one another by producing longitudinal weld seam 11, particularly continuously. Welding takes place by means of laser welding, for example. For this purpose, welding device 37 has a laser beam generation device and means for deflecting the laser beam 34 and directing the laser beam 34 onto the flange cheeks 13 (FIG. 5). In particular, laser beam 34 is oriented in such a way that it encloses an angle $\alpha$ of 8° to 25°, preferably 10° to 15°, with the horizontal transport direction 35 in which the endless hollow profile 38 is being conveyed, i.e. with the surface to be welded. This arrangement brings about the result that laser beam 34 impacts the material to be welded in the shape of an elliptical point, thereby causing a longer melt bath to be formed and the energy to be better introduced into the material. This feature is a significant advantage particularly in the case of the thin wall thickness of outer wall 6, and guarantees secure welding.

Welding device 37 is followed by a known calibration device of the device according to the invention, in which the welded endless hollow profile 38 is calibrated to its final cross-sectional shape. For this purpose, it is practical if the calibration device has multiple calibration rollers, in known manner.

Furthermore, the device according to the invention also has a device for cutting endless hollow profile 38 into hollow profiles 1, particularly spacer tubes 14 having a predetermined length, which follows the calibration device. The cutting device is, for example, a flying saw, in other words a saw that moves along with endless hollow profile 38 in the transport direction while cutting.

Hollow profile 1 according to the invention has a very low linear heat passage coefficient because of the plastic inner wall 7 and the low wall thickness of the metal outer wall 6 that is possible as a result. In particular, the linear heat passage coefficient lies at 0.03 to 0.07 W/mK, preferably 0.035 to 0.05 W/mK. The low wall thickness of metal outer wall 6 furthermore has the advantage that tremendous material costs are saved in comparison with purely metal hollow profiles. Providing such low wall thickness values for the metal outer wall 6 is particularly possible because plastic inner wall 7 supports and stabilizes metal outer wall 6, so that in particular, flange cheeks 13 can be pressed against one another with sufficient press-down forces even at such low wall thickness values, and reliable welding is achieved.

Furthermore, hollow profile 1 according to the invention can be processed further in excellent manner. In particular, spacer tubes 14 that consist of hollow profile 1 can be bent to form spacer frames, in conventional manner and on conventional machines.

Because of the metallic outer profile surface 3, the hollow profile 1 according to the invention can also be painted without problems. Furthermore, the outer profile surface 3 is UV-resistant. The spacer tubes 14 according to the invention that have the stainless steel outer wall can also be used in the renovation or expansion of buildings in which conventional spacer tubes made of stainless steel or having a metallically shiny surface were used until now, because of this stainless steel outer surface.

Furthermore, the special selection of the hot-melt adhesive 23 and the plastic material is particularly advantageous, creating a preferably firm, i.e. non-displaceable, permanent bond between plastic strip 9 and metal strip 10, i.e. of inner wall 7 and outer wall 6.

It is furthermore advantageous that production of hollow profile 1 according to the invention can take place on conventional machines, to the greatest possible extent. Only the steps of cutting and gluing plastic strip 9 onto metal strip 10 and stamping of longitudinal grooves 32 are added. Stamping of longitudinal grooves 32 in turn has the advantage that the recovery forces after rolling deformation are small enough to be ignored, since no plastic material is displaced during rolling deformation.

Furthermore, as already explained above, it also lies within the scope of the invention to coat the hollow profile with paint on the outside. For this purpose, a metal band that is relatively broad, at first, for example, which is expediently wound up onto a reel, is pulled off this reel, passed through a paint coating device, and continuously coated with paint, on one side, in this device. Coating takes place by means of application of the paint by means of a known roller printing device having an application roller, for example. After subsequent drying of the paint in a dryer device through which the coated metal band is expediently guided continuously, the coated metal band is cut into multiple longitudinal strips 10 that are parallel to one another. It is practical if this also takes place continuously, in a cutting device.

Furthermore, the production method as a whole or the individual production steps can take place continuously, in other words in a single production line, or also non-continuously, in individual devices separated from one another. In the case of the continuous method; the individual devices are disposed one behind the other, in accordance with the method sequence.

Furthermore, introduction of the longitudinal grooves into the plastic strip 9 can also take place by means of a profiled and heated profile disk or another type of material displacement under the influence of heat.

Furthermore, it is also possible to provide the plastic strip with adhesive 23 in place of metal strip 10. In particular, in this case, adhesive 23 is applied to plastic strip underside 9*b*, whereby plastic strip 9 is guided through between the two rollers 24; 25 with plastic strip underside 9*b* facing application roller 24. Subsequently, the two strips are glued to one another as described above.

Of course, the hollow profile 1 according to the invention is not restricted to use as a spacer tube 14, but rather can also be used as a hand rail and/or railing tube and/or water pipe and/or supporting tubular construction and/or substitution for the light-construction method, for example.

Although only a few embodiments of the present invention have been shown and described, it is to be understood that many changes and modifications may be made thereunto without departing from the spirit and scope of the invention.

What is claimed is:

1. A spacer tube for the production of spacer frames of insulated glazing being a tubular hollow profile comprising a double-walled profile wall having a closed outer wall and an inner wall connected to said closed outer wall, said closed outer wall being made of metal and said inner wall being made of plastic, wherein said closed outer wall has a wall thickness of 0.04 mm to 0.1 mm and said inner wall has a wall thickness of 0.15 mm to 0.5 mm, wherein the double-walled profile wall is produced by rolling deformation of a metal strip coated with a plastic strip, the metal strip having two lateral longitudinal edges that are adjacent to one another after rolling deformation, and wherein the spacer tube is welded in a longitudinal direction in a region of the two lateral longitudinal edges of the metal strip by a longitudinal weld seam.

2. The spacer tube according to claim 1, wherein the closed outer wall and the inner wall are connected with one another in non-displaceable manner.

3. The spacer tube according to claim 1, wherein the two longitudinal edges are bent around to form flange cheeks, and wherein the longitudinal weld seam welds said flange cheeks to one another or the longitudinal weld seam is configured as an overlapping weld or as a butt weld.

4. The spacer tube according to claim 1, wherein the inner wall and the closed outer wall are glued to one another.

5. The spacer tube according to claim 4, wherein the closed outer wall and the inner wall are glued to one another using a hot melt melting adhesive.

6. The spacer tube according to claim 1, wherein the closed outer wall has a wall thickness of 0.05 mm to 0.08 mm.

7. The spacer tube according to claim 1, wherein the inner wall has a wall thickness of 0.3 mm.

8. The spacer tube according to claim 1, wherein the plastic of the inner wall has biopolymers.

9. The spacer tube according to claim 1, wherein the plastic of the inner wall is at least one of a degradable plastic and a plastic made from renewable resources.

* * * * *